US009016011B2

(12) United States Patent
Stewart

(10) Patent No.: US 9,016,011 B2
(45) Date of Patent: Apr. 28, 2015

(54) INTERNALLY ALIGNED INSULATING WINDOW AND DOOR BUCK

(75) Inventor: Cooper Edward Stewart, Pelican Rapids, MN (US)

(73) Assignee: Gorilla Buck Inc., Pelican Rapids, MN (US)

( * ) Notice: Subject to any disclaimer, the term of this patent is extended or adjusted under 35 U.S.C. 154(b) by 174 days.

(21) Appl. No.: 12/932,835

(22) Filed: Mar. 8, 2011

(65) Prior Publication Data

US 2011/0214370 A1 Sep. 8, 2011

Related U.S. Application Data

(60) Provisional application No. 61/339,768, filed on Mar. 8, 2010.

(51) Int. Cl.

| | |
|---|---|
| ***E06B 1/04*** | (2006.01) |
| ***E04C 3/02*** | (2006.01) |
| ***E06B 1/32*** | (2006.01) |

(Continued)

(52) U.S. Cl.
CPC ... *E06B 1/32* (2013.01); *E06B 1/02* (2013.01); *E06B 1/30* (2013.01)

(58) Field of Classification Search
CPC ..... E06B 1/02; E06B 1/30; E06B 1/32
USPC ..... 52/204.1, 210, 213, 215, 216, 217, 427, 52/576, 731.2, 732.1
See application file for complete search history.

(56) References Cited

U.S. PATENT DOCUMENTS 2,166,870 A * 7/1939 Livesay ..... 52/213
3,160,926 A * 12/1964 Brose ..... 49/401
3,230,676 A 1/1966 Dixon (Continued)

FOREIGN PATENT DOCUMENTS

DE 4431319 A1 * 3/1996

OTHER PUBLICATIONS

Office Action Dated Mar. 26, 2013.

*Primary Examiner* — Phi A
*Assistant Examiner* — Omar Hijaz
(74) *Attorney, Agent, or Firm* — Dardi & Herbert, PLLC; Curtis B. Herbert; Kayla J. Fossen

(57) ABSTRACT

An internally aligned insulating concrete form window and door buck that self aligns into the insulated concrete wall forms and it allows for the changing of the face and edge materials when desired, and the use of solid insulating materials with internal alignment elements that fit into the cavity of the insulated concrete formed wall which bonds to the concrete. The internally aligned insulating window and door buck generally includes an insulated window and door buck made as a single insulating element or with multiple components with a configuration that allows for the use of various type of materials on the face and edges of the buck, and have the ability to align to the inside of an insulated concrete formed walls so as no external bracing or strapping or support is needed to keep the buck aligned with the wall forms during concrete placement. Having a firm insulation material as the buck is an integral part of the invention in that recesses or shapes in the insulation material can allow the fluid concrete to flow into and around these recesses and shapes and make a bond to the buck. The buck also has the ability to use single or multiple insulation elements to make up the insulating and alignment elements of the buck.

24 Claims, 17 Drawing Sheets

(51) Int. Cl.
*E06B 1/02* (2006.01)
*E06B 1/30* (2006.01)

(56) References Cited

U.S. PATENT DOCUMENTS

| | | | | |
|---|---|---|---|---|
| 7,587,868 | B2 * | 9/2009 | Hughes | 52/215 |
| 8,109,052 | B2 * | 2/2012 | Rosende et al. | 52/204.55 |
| RE43,251 | E | 3/2012 | Anderson et al. | |
| RE43,457 | E * | 6/2012 | Anderson et al. | 52/215 |
| 2003/0005659 | A1 | 1/2003 | Moore, Jr. | |
| 2008/0115431 | A1 * | 5/2008 | Mill | 52/215 |
| 2009/0193729 | A1 * | 8/2009 | Kustermann | 52/215 |
| 2009/0205272 | A1 * | 8/2009 | Rosende | 52/215 |
| 2010/0154329 | A1 | 6/2010 | Adkins et al. | |
| 2010/0251645 | A1 | 10/2010 | Philippe | |
| 2010/0269433 | A1 * | 10/2010 | Westra | 52/215 |
| 2011/0083382 | A1 * | 4/2011 | Sanders | 52/215 |
| 2011/0185661 | A1 | 8/2011 | Nauck et al. | |
| 2011/0214370 | A1 | 9/2011 | Stewart | |
| 2012/0005975 | A1 | 1/2012 | Kim | |
| 2012/0186172 | A1 | 7/2012 | Bouchard | |

* cited by examiner

INTERNALLY ALIGNED INSULATING WINDOW AND DOOR BUCK

RELATED APPLICATIONS

This application claims priority to U.S. Provisional Application No. 61/339,768 filed Mar. 8, 2010 which is hereby incorporated by reference in its entirety.

BACKGROUND OF THE INVENTION

1. Field of the Invention

The present invention relates generally to insulating concrete form window and door bucks, and more particularly, to an internally aligned insulating window & door buck.

2. Description of Related Art

Insulated concrete formed walls (ICFs), pre-cast concrete walls, or poured in place concrete walls usually require window, door and utility openings. Typically in poured concrete walls a rough or finished buck frame is installed in place prior to concrete placement to accommodate installation of finish window and door components at a later date. Wall buck frames can be either fabricated on-site or in a manufacturing facility. Currently bucks found in the art are made from standard lumber stock, manufactured plastic/vinyl bucks with or without insulation or bucks made from a combination of these materials. The use of wood, plastic or vinyl bucks often is done without any regard for insulation and when insulation is incorporated the use of exterior face plastic flanges increases the overall thickness of the wall thereby interfering with finishes or the use of temporary lumber flanges that align the buck in the walls requiring much extra labor and materials. Another shortcoming in insulated wood bucks is the issue of components delaminating during cutting and installation procedures, as well as after the wall is poured. Another problem with current bucks is they don't allow the finishing of stucco type finishes directly to the buck and when a fire rated buck material is specified there isn't a positive way to assemble and fasten the elements together in a permanent fashion such as when a material like DensGlass™ is specified. The deficiencies in these existing systems are felt in the industry whereby the need for new solutions for a more adaptable, more energy efficient, and less labor intensive window and door buck is recognized.

SUMMARY OF THE INVENTION

The invention generally relates to an insulating concrete form window and door buck which includes an insulating window and door buck made with single or multiple insulating components with a configuration that allows for the use of various types of materials on the face and edges of the insulating buck, and have the ability to fit to the inside of an insulated concrete formed wall so as no external bracing or strapping is needed to keep the buck aligned with the insulated concrete forms during concrete placement. Having a firm insulation material component as the internal alignment portion of the buck is an integral part of the invention. Additionally the use of recesses in the insulation material allows the fluid concrete to flow into these recesses and make a permanent bond to the buck.

The completed window buck frame is constructed from the assembled buck panels that are joined together at the intersecting corners. The assembled window buck gets positioned into an insulated concrete wall cavity to stay in place as a permanent window or door frame.

The insulating internal alignment elements are on the interior of the buck face panels and fit into the interior sides of insulated concrete forms. The alignment elements extend into the insulated concrete wall cavity far enough to secure the buck into position with the insulated concrete wall forms during concrete placement. The insulating internal alignment elements may have shaped sides or recesses that allow the fluid concrete to flow around the alignment elements and to lock them into the concrete wall once the concrete is cured. The insulating alignment element edges may be beveled or eased to allow an easier assembly into the insulated concrete block without binding.

One variation of the internal alignment elements is to have a solid piece of insulating material, with or without keyways as part of the interior of the buck face panel, without continuous locking edge components.

Another variation is to have individual alignment elements spaced along the back of the buck face panel, instead of continuous alignment elements.

Another variation is to have the internal alignment elements molded directly onto a buck face panel.

Another variation is to have individual concrete bonding indentations or shapes positioned into the internal alignment elements.

Another variation is to have a notch recess into the internal alignment element as a method for bonding to concrete.

The face of the insulating concrete formed window buck invention may be interchangeable with different materials to accommodate differing site conditions and finish requirements. The differing face materials can be bonded with adhesives, heat process, fasteners, or through the use of overlapping edge components, or other methods.

The process to change buck face panels starts with cutting to size the new face panel material and then fastening it to the edge elements when present and to the center insulation components using adhesives and or fasteners, and or edge clips or tracks or other fastening methods.

One variation of the changeable buck face panels is to directly mold the internal buck insulating component to the backside of the new buck face panel with or without a locking edge component.

Another variation is to use a field installed bracket or clip to bond the new face panel in place.

Another variation is to use a shaped edge profile to bond the new face panel material to the edge elements.

Another variation is to use edge clips to bond the new face panel to the edge elements.

Another variation is to use integrated insulating trim elements pre-installed or molded to the window buck prior in installation.

The internal alignment component can be manufactured from insulating materials to keep the newly placed concrete at the required temperature for proper curing. The insulating internal alignment elements that fit into the insulated concrete wall forms can be made from a single piece or multiple pieces of insulating material. The insulating components may be held to a buck face with overlapping joints, or grooved edges, or no edge elements. The insulating materials can be made to bond to the concrete wall with shapes or recesses that the concrete flows into, or around and then locks it into place when cured.

The backside of a face panel may have an insulating component that in addition to providing a positioning element into the insulated concrete wall also protects the curing concrete from extreme temperature swings. The insulation component may have built in recesses, or shapes that allow the insulation to bond directly to the concrete. The centered insulation element may lock into position with a locking edge component.

One variation of the internal insulating alignment component is to have multiple pieces of solid insulating material make the center and alignment elements, instead of a single insulating piece.

Another variation is to use tapered edges, keyways or recesses in the insulating components to lock them into the concrete.

Another variation is to use a sliding interlock to adjust to different wall widths.

Another variation is to use an overlapping interlock.

Another variation is to attach the insulation component to a buck panel with tapered edge elements.

Another variation is to attach the insulation component to a buck panel with notched edge elements.

Another variation is to attach the insulation components to a buck face using adhesive.

Buck edge elements can be constructed from many different materials, it can enable fastening of any finish materials or windows and doors. Edge elements also can be used to hold in place the center insulating components by way of overlaps, grooves, or keyway. Edge elements can be continuous or separate elements aligned in positions along the edges of a buck face.

Continuous locking edge components may provide additional fastening for windows, doors, and trim at the interior and exterior edges of a buck frame. Edge pieces may be bonded to a face panel there by providing a tapered locking mechanism for the internal insulation components as well.

One variation of a locking edge component is to have a tongue and groove or spline connection.

Another variation of a locking edge component is to have a notch for securing the internal buck insulating component in place.

Another variation of a locking edge component is to not have one at all and the fastening of the internal buck insulating component to the backside of a face panel may be done with adhesives and or fasteners or not install a changeable face at all.

Another variation is to have a tongue and groove edge to lock the insulation components to a face panel.

Another variation is to have clips that lock the insulation components to a face panel.

The back side of the insulating window buck invention has internal alignment elements that fit to the inside of insulated concrete wall forms, centering and fixing the buck into the proper position for concrete placement. These internal alignment elements can be continuous or spaced elements.

The internal alignment elements can have a taper or recess or shapes so as to allow for better bonding to the concrete wall when cured.

The firm insulating internal alignment elements provides a tight fit of the assembled window buck frame to the insulated concrete wall form cavity. The top edges of the internal alignment elements may have chamfered edges to assist in inserting the buck frame into the insulated concrete wall forms. The internal alignment elements can be shaped with a taper, groove, keyway, recesses or other shapes towards the liquid concrete to allow a better bond between the alignment elements and the concrete.

The internal alignment elements can be constructed of any firm material that is compatible with concrete and moisture. Internal alignment elements can also be uniform without concrete bonding features. The internal alignment elements can either be integrated into a single internal buck insulating component or into separate elements that combine into a multiple piece insulating internal buck component.

The complete buck panel may have a changeable buck face panel that can be bonded to locking edge components and the internal buck insulating component(s) which have the internal alignment elements. A single buck panel is one side to a completed buck frame.

A buck panel becomes a usable product once it has all of its elements in place. The internal alignment elements extend beyond the surface of the insulating portion so they/it can lock into the cavity of the insulated concrete wall forms.

The buck panel can also be constructed of molded insulating materials that may be bonded directly onto the face material with or without locking edge components. A buck shaped hollow shell made from a wide array of materials may also have the insulating material directly molded into the shell shape, or inserted.

A pair of insulated concrete form side panels that have an inside face, and exterior face and the panels having edges on the top sides and bottoms, the side panels have a system of webs that hold the parallel side panels in position during concrete placement.

The typical ICF wall forms are comprised of a set of webs that keep the parallel spaced side insulation panels properly spaced and in position during concrete placement. The side insulation panels have top bottom and side edges that align with each other and may interlock together.

Some ICFs are made with plastic webs some with steel, several different types of solid insulations are used as the panel material and many different types of side panel interlocks are available for all edges of the side panels.

An object is to provide an internally aligned insulating window & door buck for self alignment into insulated concrete forms.

Another object is to provide an internally aligned insulating window & door buck that allows for the change and incorporation of any finish or rough face panel or edge materials during manufacturing.

Another object is to provide an internally aligned insulating window & door buck that provides an internal insulating material that can be bonded to various face and edge components.

Another object is to provide an internally aligned insulating window & door buck that has single or multiple concrete bonding keyways or recesses or elements.

Another object is to provide an internally aligned insulating window & door buck that allows for interlocking internal insulating components to be made from either singular or multiple pieces for different insulated concrete forms and application and requirements.

Another object is to provide an internally aligned insulating window & door buck that can use an overlapping or sliding arrangement in the insulating element to easily and quickly adjust for multiple size requirements.

Another object is to provide an internally aligned insulated window & door buck that has internal elements that can be shaped with bevels, recesses or other shapes so as to bond to concrete better.

The preferred embodiment of the present invention comprises an insulating window and door buck system used primarily in insulated concrete wall forms and the like. More specifically, the present invention provides a buck system for window and door buck frames in insulated concrete formed walls: a main buck panel having opposing edges, a finished face, an alignment face and a first end and a second end. The internally aligning insulating buck panels are joined end to end in the shape of the opening to form a frame that is left in place after pouring the concrete into the insulated wall forms.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

The attached drawings are included to provide additional understanding of the invention and are to be considered part of this description that illustrates the embodiments of the invention, and together with the detailed description provide an explanation of the principles of the invention.

Wherein the drawings.

DETAILED DESCRIPTION OF THE DRAWINGS

Figure 1:
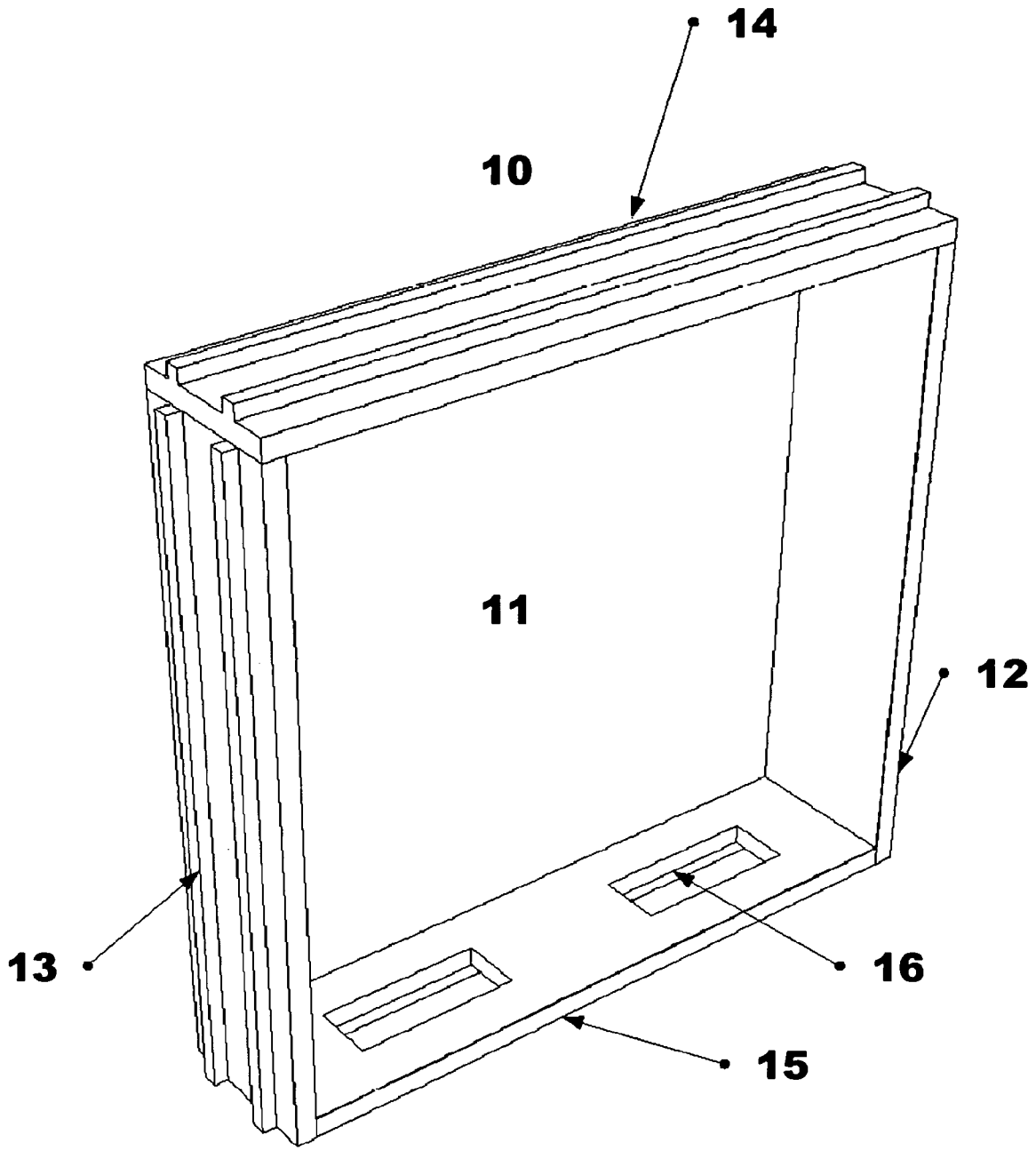
FIG. 1 is an upper perspective view of the present invention showing an upper left isometric view of an assembled window buck frame, used in the construction of insulated concrete walls.
Figure 2:
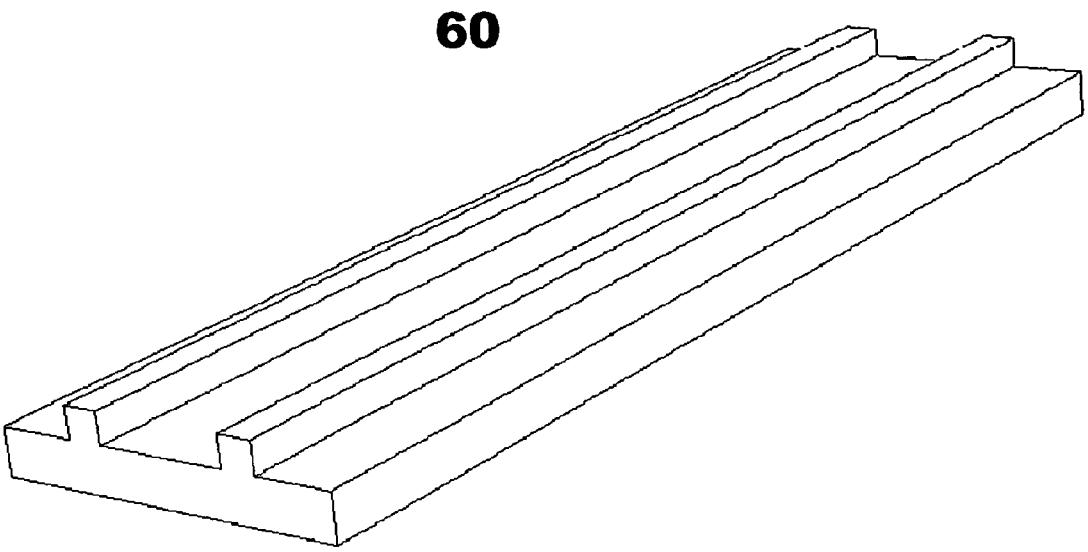
FIG. 2 is an upper perspective view of the present invention showing an upper right isometric view of a single piece of window buck ready to install into a rough opening frame.
Figure 3:
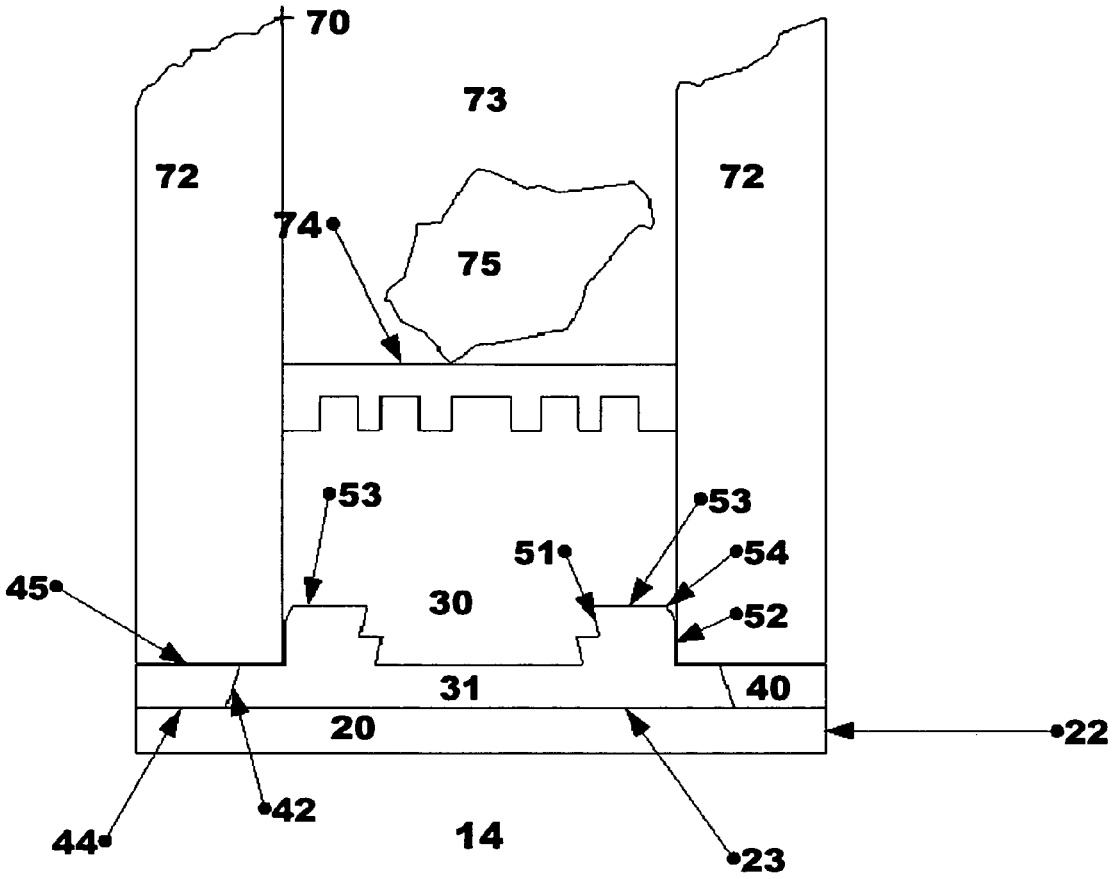
FIG. 3 is a front view of the present invention showing a section view of a top buck panel installed in an insulated concrete wall.
Figure 4:
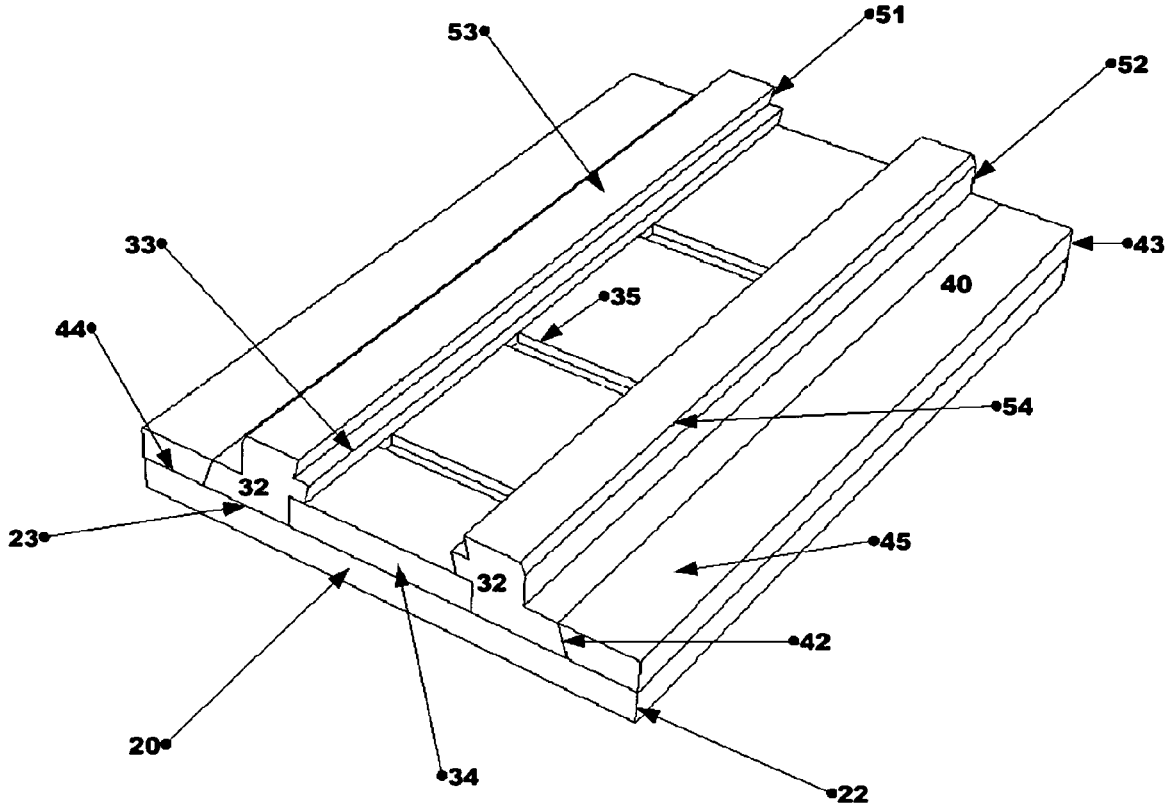
FIG. 4 is an upper perspective view of the present invention as an isometric view of an assembled multi piece insulating buck panel.
Figure 5:
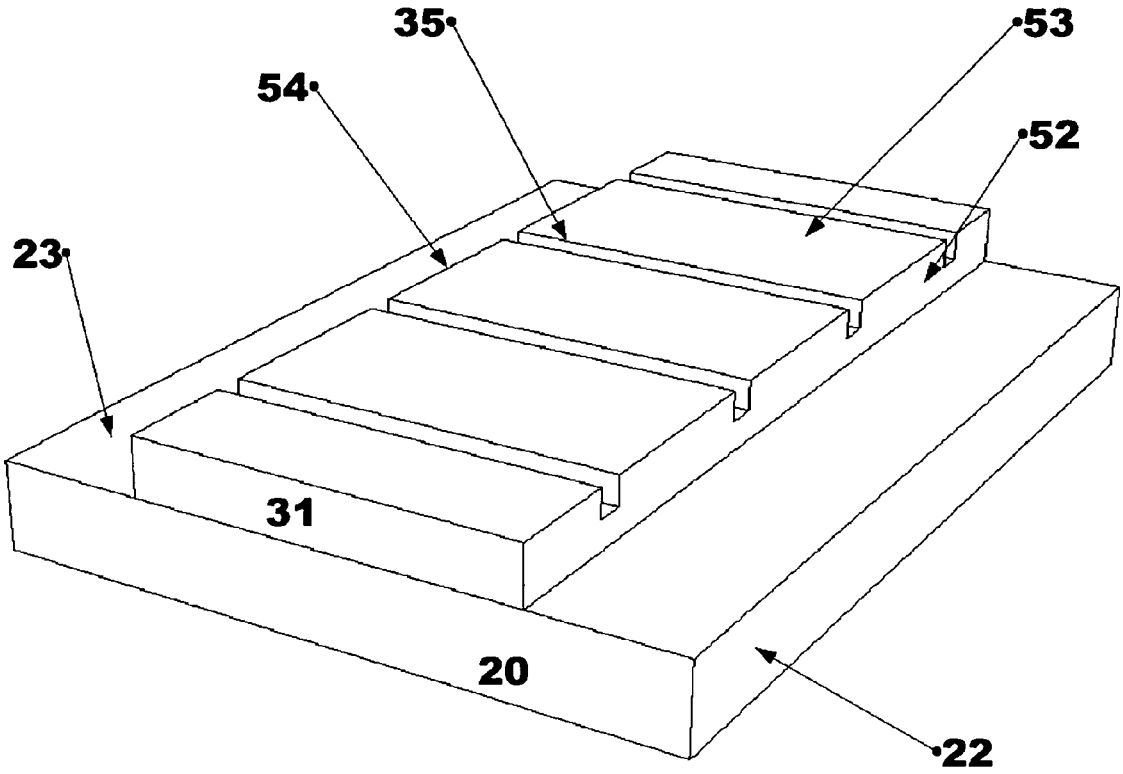
FIG. 5 is an upper perspective view of the present invention showing an insulating changeable buck face panel on a single piece of insulating internal alignment element.
Figure 6:
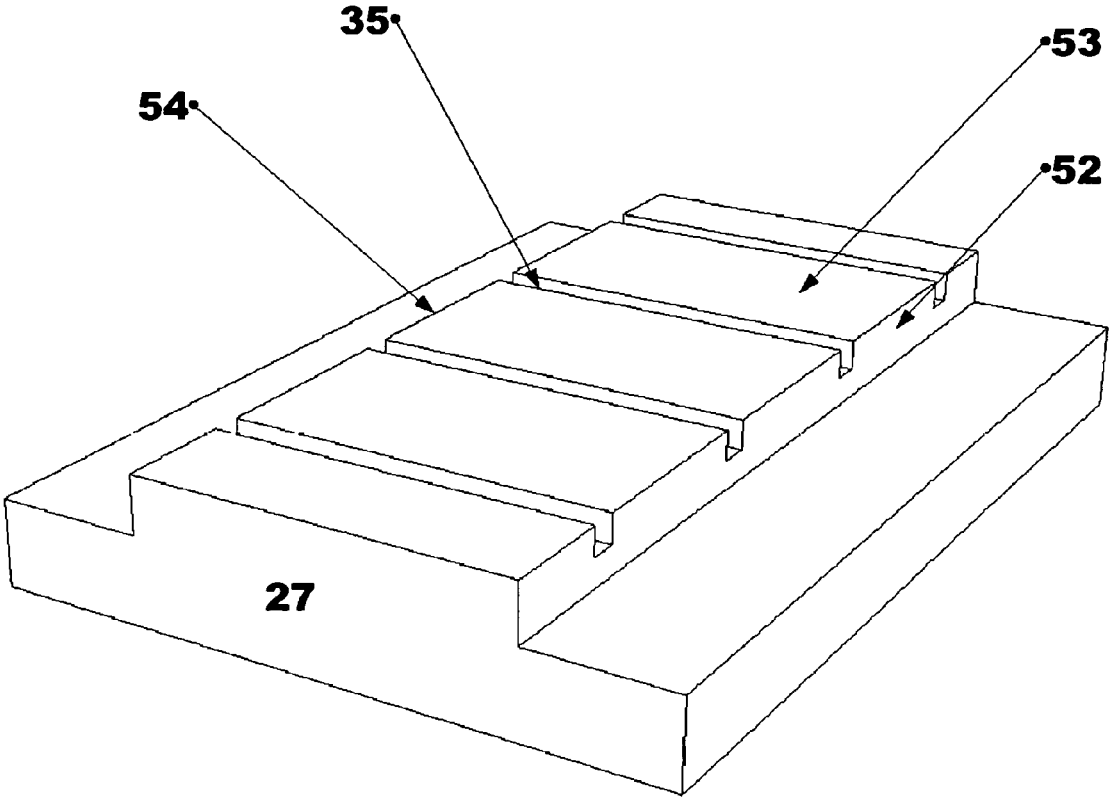
FIG. 6 is an upper perspective view of the present invention showing a single piece insulating buck with a single integrated internal alignment element.
Figure 7:
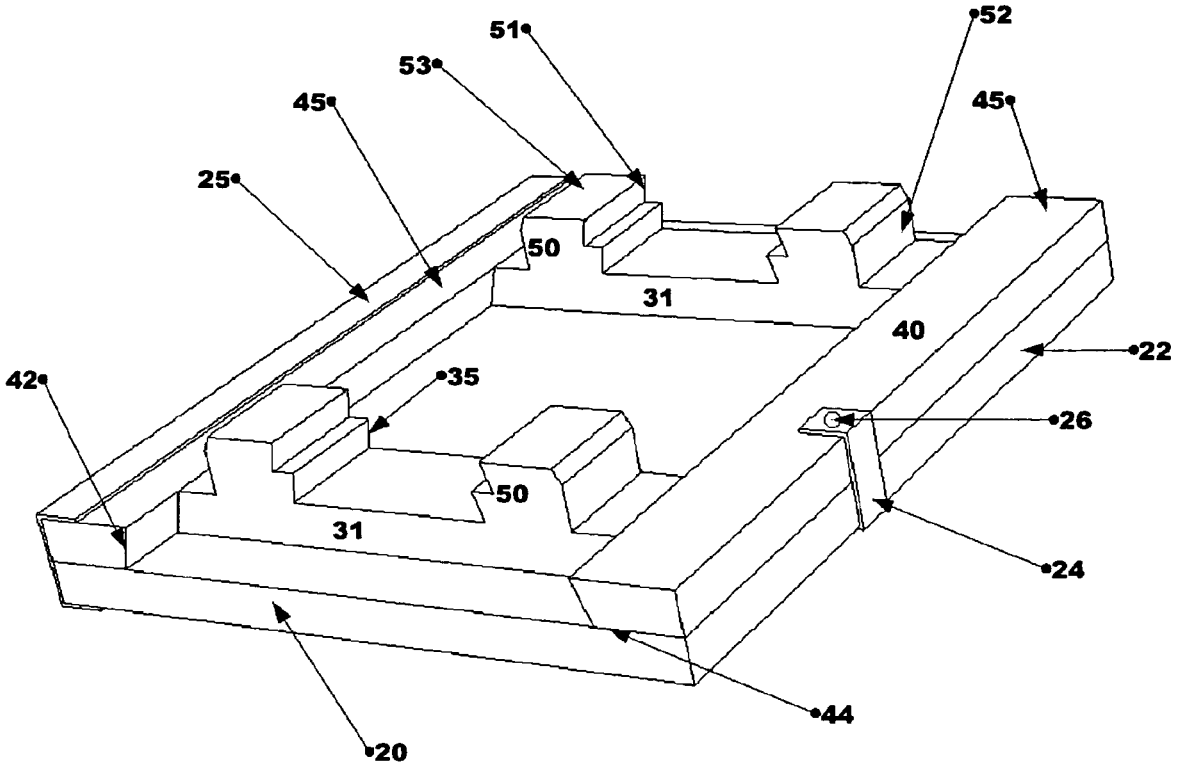
FIG. 7 is an upper perspective view of the present invention showing a perspective view of an assembled buck panel with a single piece insulating alignment component installed in a spaced configuration.
Figure 8:
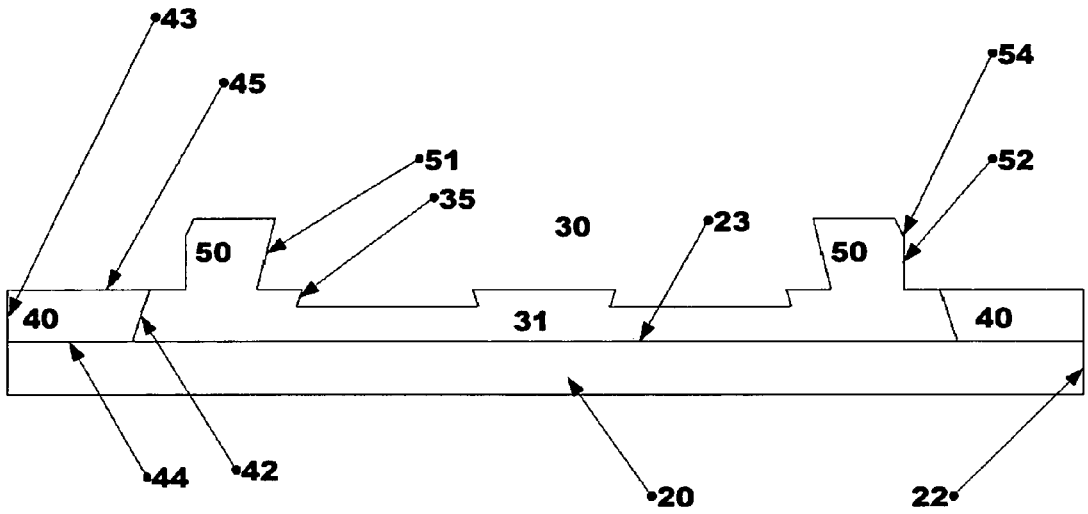
FIG. 8 is an end view of the present invention showing an end view of a buck panel with a single insulating alignment element and tapered edge elements with multiple recesses for concrete bonding.
Figure 9:
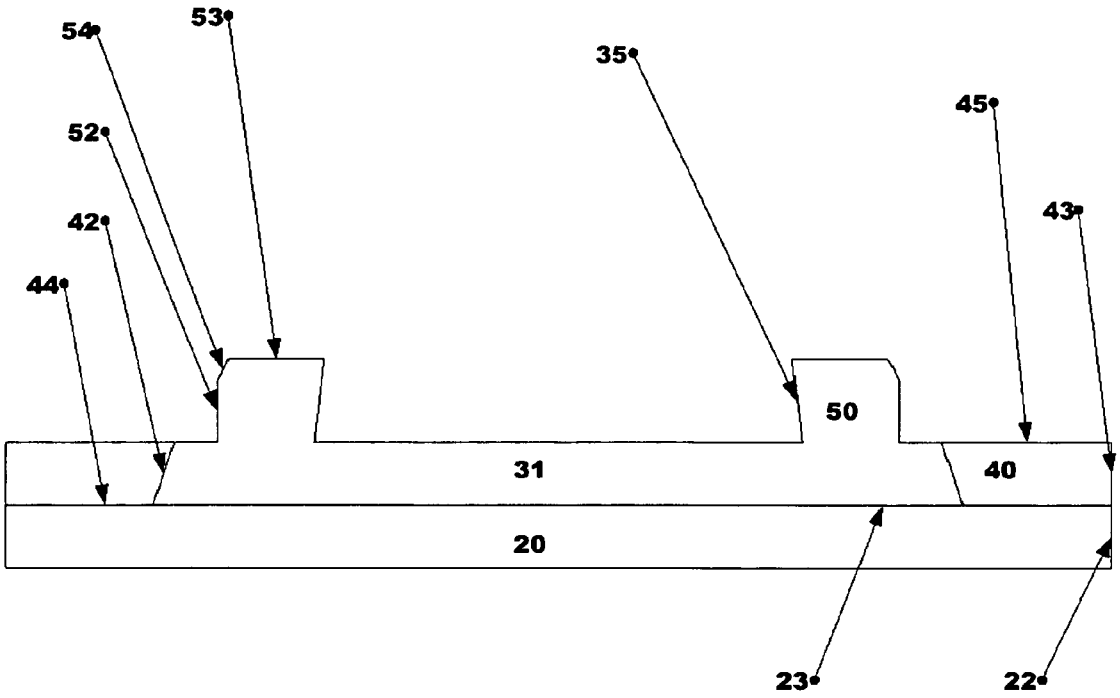
FIG. 9 is an end view of the present invention showing an end view of a buck panel made with a single piece insulating element with no bonding recesses and tapered edge pieces.
Figure 10:
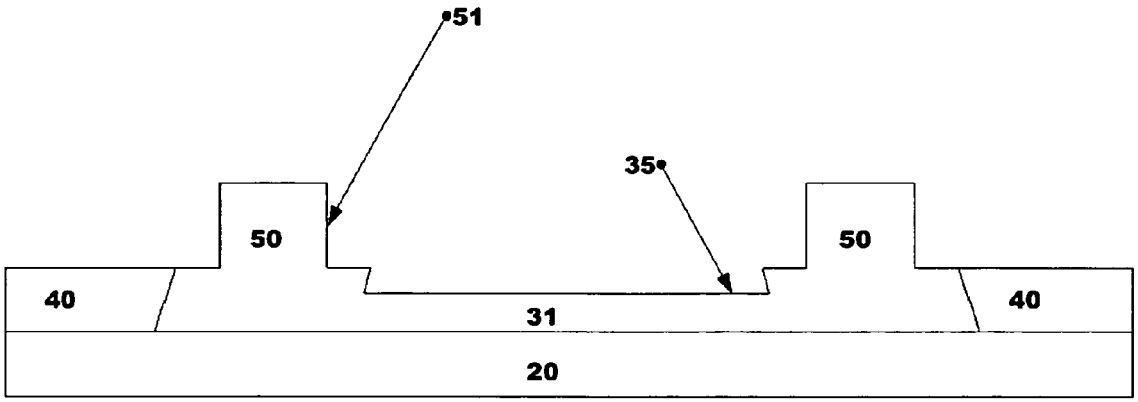
FIG. 10 is an end view of the present invention showing an end view of a buck panel with a uniform single piece insulating alignment element with a single concrete recess.
Figure 11:
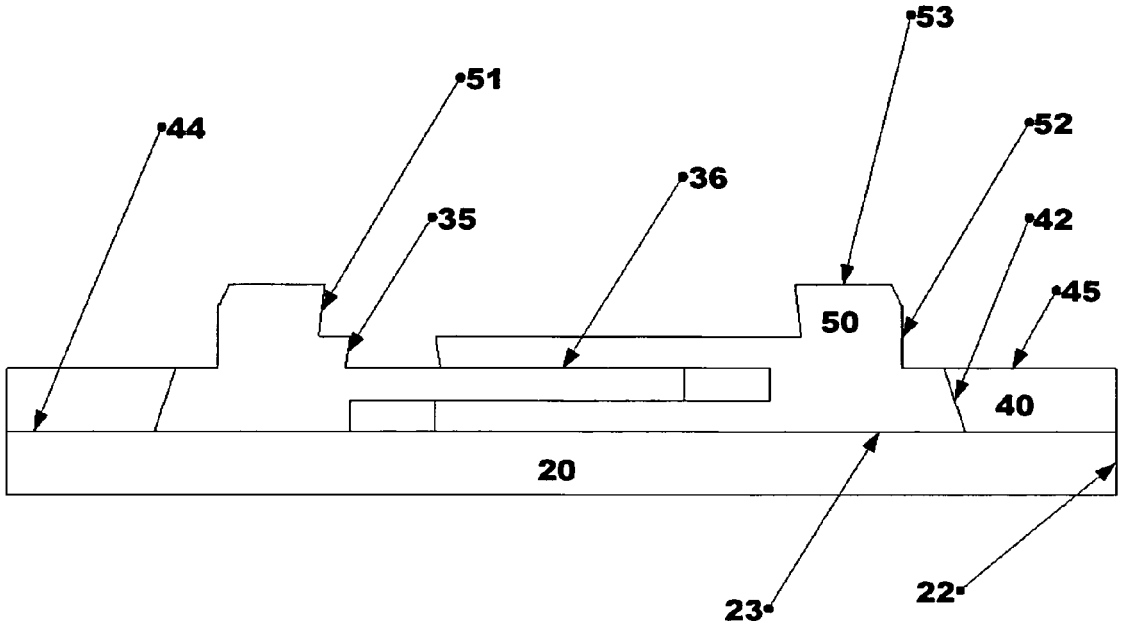
FIG. 11 is an end view of the present invention showing an end view of a buck panel with a sliding interlock in the internal alignment element
Figure 12:
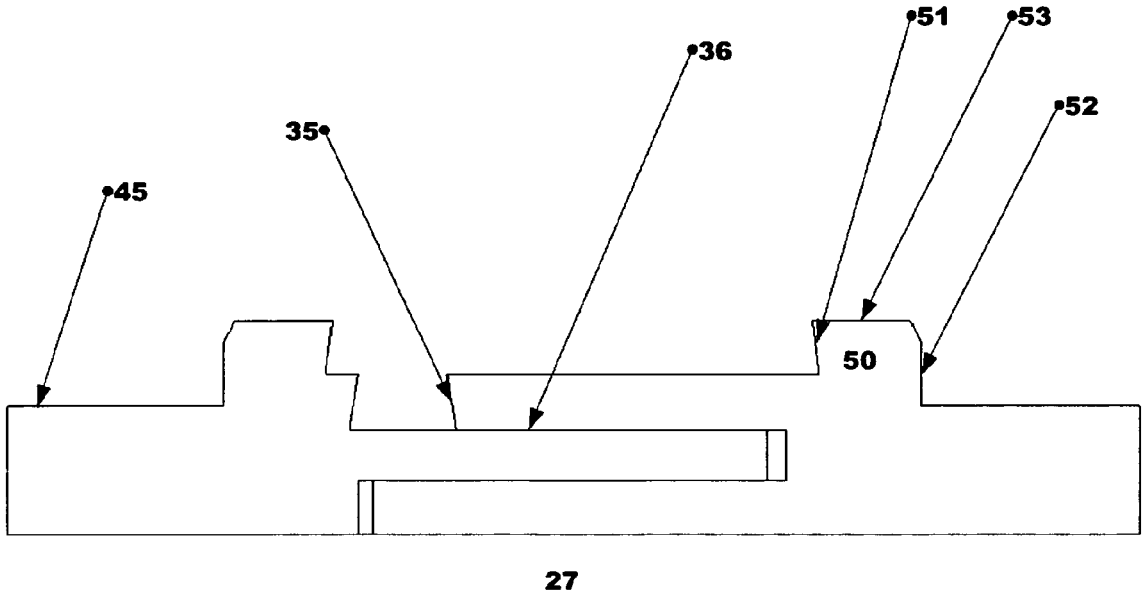
FIG. 12 is an end view of the present invention showing an end view of a buck panel with a sliding interlock in the internal alignment element with no additional face or edge elements.
Figure 13:
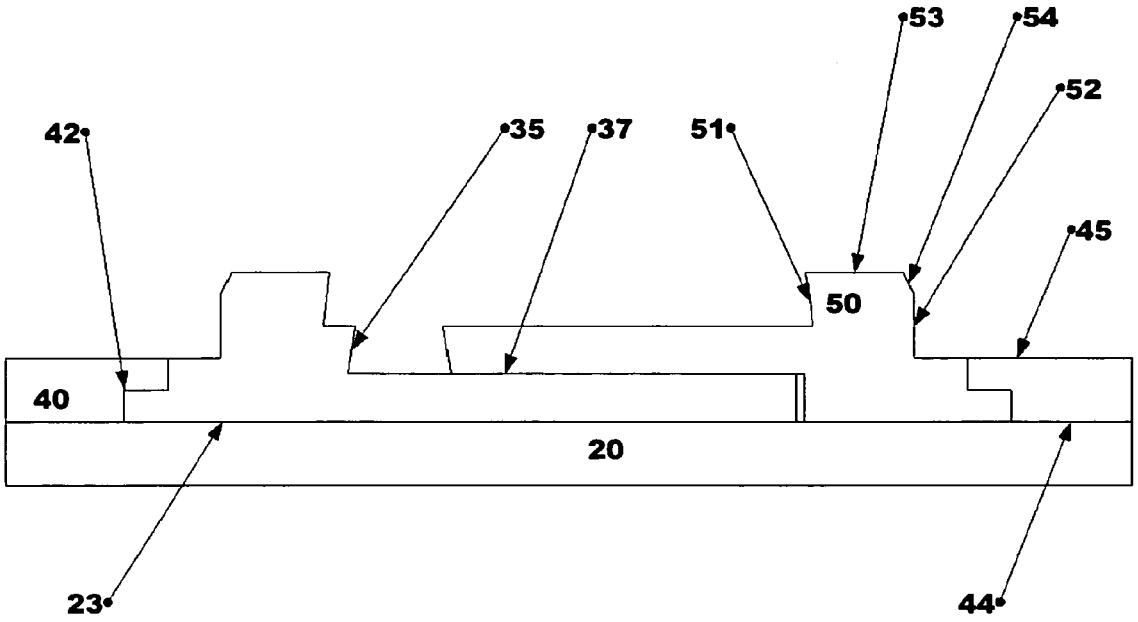
FIG. 13 is an end view of the present invention showing an end view of a buck panel with an overlapping interlock in the insulating internal alignment elements as well as notched edge elements.
Figure 14:
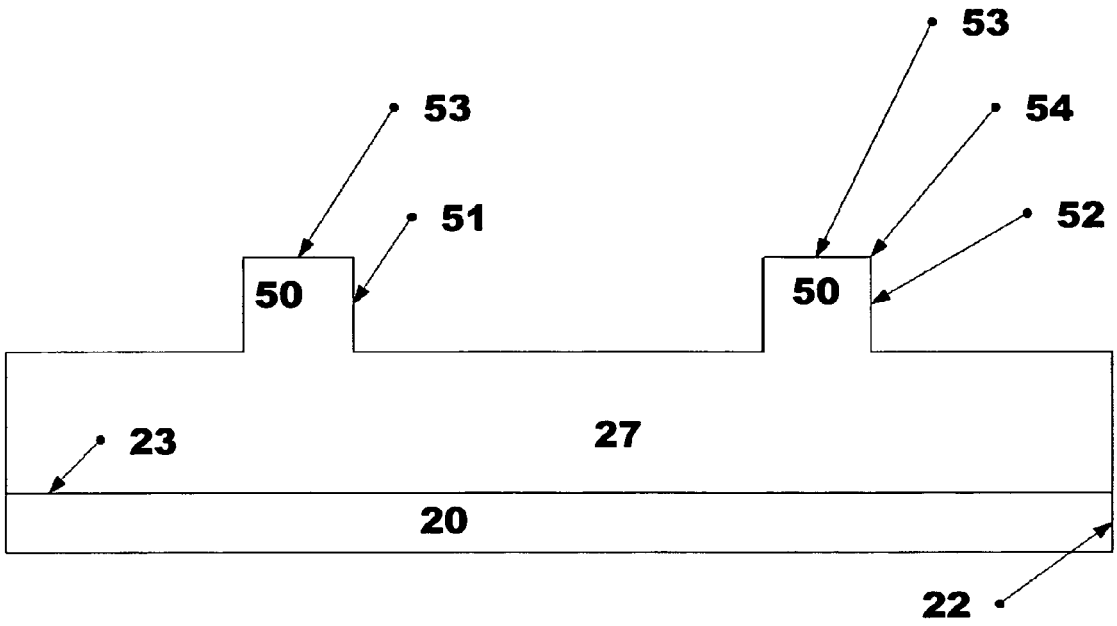
FIG. 14 is an end view of the present invention with an end view of a buck panel showing a changeable buck face panel joined to single piece insulating internal alignment element with uniform embedments, and no additional edge elements.
Figure 15:
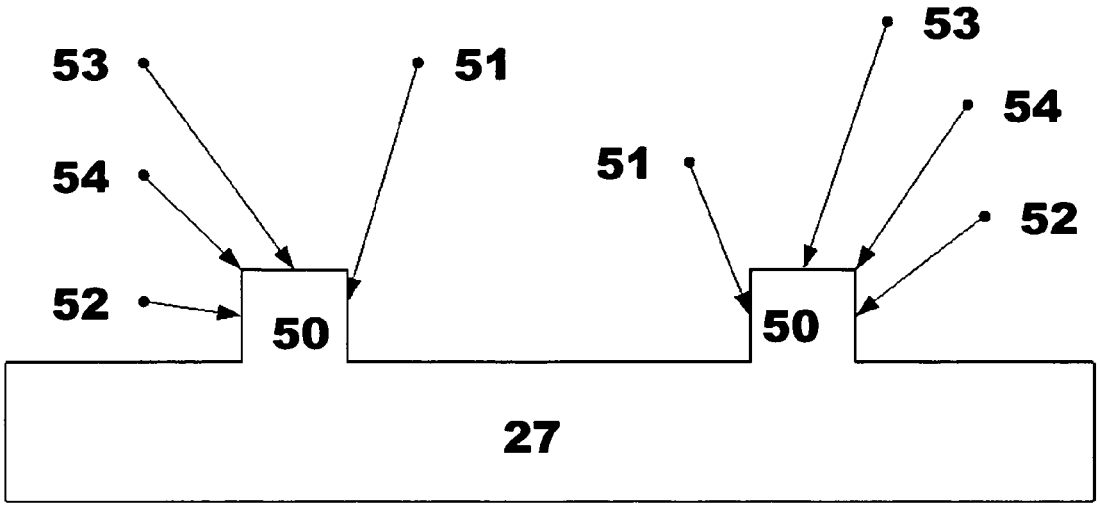
FIG. 15 is an end view of the present invention showing an end view of a buck panel with no changeable buck face or added edge elements.
Figure 16:
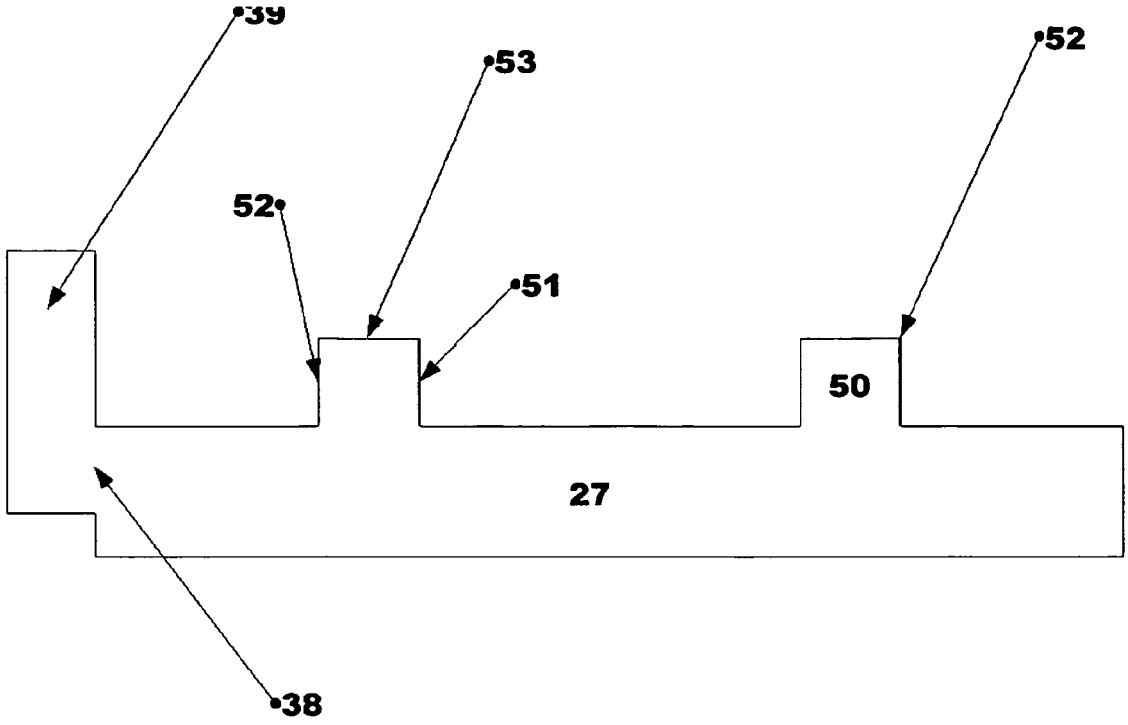
FIG. 16 is an end view of the present invention showing an end view of a buck panel with the integrated pre-molded trim element.
Figure 17:
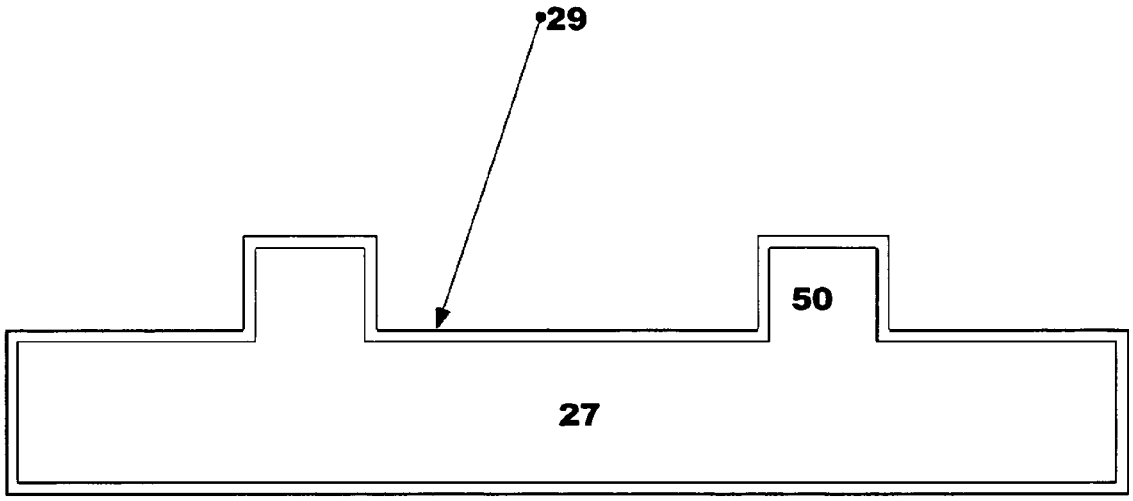
FIG. 17 is an end view of the present invention showing an end view of a buck panel having a shell material with insulating elements inside.

The present invention is referred to generally in FIGS. 1-17 by the reference numeral 10 and is intended to provide for internally aligned insulating window & door bucks and the like. Like numbers refer to like elements throughout the figures. It should be understood that the device 10 may be used in a variety of wall forms and is not to be limited in use to only insulated concrete forms. Furthermore, it is noted that the present invention may be monolithically formed as a single unit thereby negating the necessity to mechanically attach its various parts together.

The assembled window buck frame 10 has a top panel 14 attached to the first side panel 12 and the second side panel 13 with both side panels sitting on the bottom panel 15 which make up a complete window buck frame. The bottom panel 15 has concrete placement ports 16 spaced so as to allow access to consolidating concrete under the window frame 10 during concrete placement. The panel intersections of 12 13 14 15 may be fastened together with screws or nails or clips or no connectors can be used for joining the panels together. The rough opening 11 is the area open area inside the assembled frame 10. The assembled window buck 10 is installed into the insulated concrete wall blocks 70 with the internal alignment elements 50 projecting into the insulated concrete wall block 70 and abutting against the insulated concrete form side panel edges 72.

The changeable buck face panels 20 have a backside as buck face panel 23 and opposing edges of buck face panels 22. The option of adding face material with changeable buck face panels 20 made from a wide array of building materials which may be attached to locking edge components 40 by using adhesives, fasteners or singular edge clips 24 or continuous edge track 25 both of which may have fastening holes 26 or may be crimped or slid into place.

The internal buck insulating component 30 may be constructed as a single piece insulating components 31 or 27 or multiple piece insulating alignment components 32 which combine with center insulating piece 34 and can be held into position with overlap stops 33. The internal buck insulating component 30 may have concrete attachment recesses 35, another option when joining multiple piece insulation components 32 together they may be joined with a sliding interlock 36 or overlapping interlock 37.

Locking edge components 40 can help bond changeable buck face panels 20 together in addition to using adhesives and/or fasteners, The continuous edge piece 40 has an inside locking edge 42. The outside edge 43 of a locking edge component is positioned to be flush with the edge of buck face panel 22, and the bottom face 44 of a locking edge component 40 may be joined together with the backside of buck face 23 and the top face 45 of a locking edge component 40 maybe positioned to adjoin the insulated concrete form side panel edges 72.

The internal alignment elements 50 may have an inside locking face 51 which can bond with the concrete 75 and an outside alignment face 52 which sits against the insulated concrete form side panel edges 72. The alignment element top 53 of the internal alignment elements 50 project into the wall cavity 73 and can bond to the concrete 75. When the assembled window buck frame 10 is being installed into the insulated concrete form wall block 70 it helps to install when the edges of top face 45 have a chamfered or eased edge 54. When the internal alignment elements 50 are installed into the insulated concrete wall block 70 and the insulated concrete form webs 74 interfere with the full insertion of the assembled window buck frame 10 it is very simple to break off or notch the internal alignment element top 53 of the internal alignment elements 50 so it can engage fully past a close obstruction.

The backside of buck face 23 of a changeable buck face panel 20 may be attached to locking edge components 40 via various attachment methods commonly used in joining the specific types of building materials. The internal buck insulating components 30 31 may be joined to a changeable buck face panel 20 through a mechanical, chemical, heat process or molding in place to a changeable buck face panel 20 or no buck face may be added. A continuous locking edge strip 40 may be joined to backside 23 of buck face panels 20 using adhesives or fastening. Once the assembled individual linear buck elements 60 are manufactured they may be cut to length and joined together via various attachment methods.

As a preferred embodiment, the installer first measures the correct rough opening 11 for the assembled window buck frame 10, and then cuts to the correct length the buck panels 60. Then the panels 60 are assembled as the sides 12, 13, top 14, and bottom 15 and joined together at the intersecting joints. When the installer has the insulated concrete wall block 70 stacked up to the height of the bottom panel 15 the assembled window buck 10 can be set into position on top of the insulated concrete wall block 70. The internal aligning elements 50 project to the inside of the insulated concrete wall cavity 73 using the chamfered edges 54 to help fit it into the insulated concrete wall cavity 73. The outside alignment face 52 of the internal alignment elements 50 fit snuggly against the inside faces of the insulated concrete form side panels 72 of the insulated concrete wall block 70. The installer would then cut concrete placement ports 16 into the bottom panel 15 for concrete placement and consolidation. The balance of the insulated concrete wall blocks 70 would then be installed around the assembled window buck 10. The wall concrete 75 is then poured into the wall forms made from the insulated concrete wall blocks 70. The fresh concrete bonds to the internal alignment elements 50 and specifically against the inside locking face 51, furthermore the concrete recesses 35 provide additional bonding of the back side of the buck 30. Once the concrete is cured the installer can install windows or doors into the rough buck openings 11.

During the manufacture of buck panels 60 the internal alignment side of the panels 23 can be joined to internal buck insulating component 30 in either a single piece insulating component 27 31 or in multiple piece insulating components 32 and 34 the use of adhesives fasteners and or continuous edge piece 40 maybe used to align and hold the internal buck insulating component 30 in position when required, the multiple piece insulating components may be bonded together with adhesives or fasteners or the overlap stop 33, or a sliding interlock 36 or an overlapping interlock 37 may also be used for bonding and adjustability, the bottom face 44 of the locking edge component 40 may be fastened to a changeable buck face panel 20 on the backside of buck face 23 with adhesives or fasteners or edge clips 24 or continuous edge tracks 25 with using either fasteners or crimping or interlocks or sliding mechanism or adhesives.

The internal buck insulating components 34 may be molded in place or inserted into hollow shells of various material that include the configurations of the internally aligned elements.

The internal buck insulating components 27 30 31 32 34 may be molded in place or inserted into hollow shells 29 of various material that include the configurations of the internally aligned elements.

The internal buck insulating component 30 whether constructed with single piece insulating elements 27 31 or multiple piece insulating alignment components 32, a premolded finish trim element 39 can be molded together at connection 38 or can be added at the factory.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated.

I claim:

1. An internally aligned insulating window and door buck that fits with insulated concrete wall forms that have two side panels having substantially parallel interior faces that are separated from each other by a wall form cavity, said buck comprising:

a rough opening frame system comprising a top buck piece, a bottom buck piece, and side buck pieces, each said buck piece having an exterior surface, an interior surface, and first and second outer edge faces that join the exterior surface and the interior surface, said side buck pieces being joinable to the top buck piece and to the bottom buck piece to thereby form a rough opening frame assembly wherein the exterior surfaces of the buck pieces define an opening, with at least one of the buck pieces comprising insulation and the interior surface of said at least one buck piece comprising an internal alignment element that comprises a first alignment face and a second alignment face, a first substantially flat face that connects the first outer edge face of the buck to the first alignment face, a second substantially flat face that connects the second outer edge face to the second alignment face, and a gap defined on three sides by an outer edge plane comprising substantially all of the first outer edge face, the first substantially flat face, and the first alignment face, with said alignment faces being substantially perpendicular to said first substantially flat face and said second substantially flat face, said internal alignment element being proportioned to fit inside a cavity of an insulated concrete wall form to position the buck for concrete placement with the internal alignment faces in contact with interior faces of an interior wall form, wherein the interior surface of the buck piece is unitary, and wherein the exterior surface is substantially flat.

2. The buck of claim 1, wherein all of said buck pieces comprise internal alignment elements that are comprised of an insulating material.

3. The buck of claim 1 further comprising a recess in said interior surface of said at least one buck piece.

4. The buck of claim 1 wherein said internal alignment element is shaped to bond to concrete.

5. The buck of claim 1 further comprising integrated insulating trim elements pre-installed or molded to said window buck prior to installation.

6. The buck of claim 1 further comprising chamfered or eased edges on said internal alignment element.

7. An internally aligned insulating window and door buck, said buck comprising:

a rough opening frame system comprising a top buck piece, a bottom buck piece, and side buck pieces;

each said buck piece having an exterior surface and an interior surface joined by first and second outer edge faces, with the side buck pieces being joinable to the top buck piece and to the bottom buck piece to thereby form a rough opening frame assembly wherein the exterior surfaces of the buck pieces define an opening, with at least one of the buck pieces comprising insulation and the interior surface of said at least one buck piece comprising a plurality of internal alignment elements, a first substantially flat face that connects the first outer edge face to a first of the internal alignment elements, a second substantially flat face that connects the second outer edge face to a second of the internal alignment elements, said first of the internal alignment elements comprising a first alignment face and the second of the internal alignment elements comprising a second alignment face, said first and second internal alignment faces being substantially parallel to each other and substantially perpendicular to said first and second substantially flat faces, and a gap defined on three sides by an outer edge plane comprising substantially all of the first outer edge face, the first substantially flat face, and the first alignment face, wherein the interior surface of the buck piece is unitary, and wherein the exterior surface is substantially flat.

8. The buck of claim 7 further comprising edge clips attaching a buck face panel to said buck pieces when said pieces are made into an assembled frame.

9. The buck of claim 7 further comprising an adhesive attaching a buck face panel to said insulating material.

10. The buck of claim 7 further comprising a shaped edge profile.

11. The buck of claim 7 further comprising recesses in said interior face of said insulating material.

12. The buck of claim 7 wherein said alignment elements are shaped to bond with concrete.

13. The buck of claim 1 wherein the at least one buck piece comprises the top buck piece.

14. The buck of claim 1 wherein the at least one buck piece comprises the top buck piece, the bottom buck piece, and the side buck pieces.

15. The buck of claim 1 wherein the interior alignment elements and the substantially flat faces comprise the insulation.

16. The buck of claim 1 wherein all of the interior surface of said at least one buck piece is made of the insulation.

17. The buck of claim 1 wherein the buck is made of one piece of insulating material.

18. The buck of claim 7 comprising wood, vinyl, lumber, stucco, or DENSGLASS.

19. The buck of claim 1 wherein said at least one buck piece interior face meets the first outer edge face of the buck at a connecting edge, said connecting edge being squared, chamfered, rounded, or eased.

20. The buck of claim 7 wherein there are two internal alignment elements that each comprise one of said alignment faces.

21. The buck of claim 7 wherein the interior surface meets the first outer edge face of the buck at a connecting edge, said connecting edge being squared, chamfered, rounded, or eased.

22. The buck of claim 1 further comprising the insulated concrete wall forms that have two side panels having substantially parallel interior faces that are separated from each other by the wall form cavity.

23. The buck of claim 7 further comprising insulated concrete wall forms that have two side panels having substantially parallel interior faces that are separated from each other by the wall form cavity wherein the internal alignment elements fit inside the wall form cavity of the insulated concrete wall form to position the buck for concrete placement with the internal alignment faces in contact with the interior faces of the interior wall form.

24. The buck of claim 7 wherein at least one of the plurality of internal alignment elements comprises a concrete bonding face substantially parallel to the first alignment face wherein the concrete bonding face comprises a recess.

* * * * *